United States Patent [19]

Dubovick et al.

[11] 4,428,326

[45] Jan. 31, 1984

[54] INFIRMED PET AMBULATOR

[76] Inventors: Carol A. Dubovick; Marion R. Drake, both of P.O. Box 1897, New Port Richey, Fla. 33568

[21] Appl. No.: 364,438

[22] Filed: Apr. 1, 1982

[51] Int. Cl.[3] ..... A61D 3/00

[52] U.S. Cl. ..... 119/102

[58] Field of Search ..... 119/102, 103, 100

[56] References Cited

U.S. PATENT DOCUMENTS

| | | | |
|---|---|---|---|
| 1,366,178 | 1/1921 | Hatch | 119/102 |
| 3,621,819 | 11/1971 | Hooper | 119/103 |
| 4,130,091 | 12/1978 | Knudson | 119/102 |
| 4,185,591 | 1/1980 | Patelis | 119/102 |

*Primary Examiner*—Hugh R. Chamblee

*Attorney, Agent, or Firm*—Ronald E. Smith

[57] ABSTRACT

A portable structure for at least partially supporting domesticated pets suffering from an injury of or disease affecting one or more limbs.

A frame apparatus having shock absorbing wheel-supported upstanding legs carries a pair of transversely disposed straps that support the pet along its underbelly. The length, width and height of the frame are adjustable to accomodate pets of differing sizes.

Means are provided to restrain the structure against unrestricted rolling of the wheels to enhance the safety of the pet supported thereby.

6 Claims, 3 Drawing Figures

INFIRMED PET AMBULATOR

BACKGROUND OF THE INVENTION

1. Field of the Invention

This invention relates generally to therapeutic devices for injured or diseased pets and more specifically to a device the size of which is readily adjustable in three dimensions to accommodate pets of differing sizes.

2. Description of the Prior Art

A search of United States Patents located the following patents: U.S. Pat. Nos. 2,976,840 to Hugus; 2,546,726 to Creamer, Jr.; 3,215,117 to Short; 3,241,851 to Dingbaum and 3,406,661 to Parkes.

While each of these patents disclose functional devices, there is a need for a pet supporter of greater adaptability and less cost than the structures known heretofore.

Most of the earlier devices have limited utility in that only the hind legs of the animal may be supported by such devices. Further, those few earlier devices that do purport to provide support to the front and hind legs of the pet are of complex structure and consequently do not allow the pet to be easily placed in and removed from the support apparatus.

SUMMARY OF THE INVENTION

The longstanding need for a device that overcomes the shortcomings of the prior art devices is now provided in the form of an assembly that comprises a rectangular in plan view frame assembly having wheel-supported upstanding legs defining the corners thereof. The respective lengths of the individual legs are adjustable, as are the lengths of the longitudinally and transversely disposed brace members that interconnect the legs and provide rigidity to the structure. Releasably secured strap members extend between transversely spaced ones of the longitudinally disposed braces and serve to support the pet at longitudinally spaced portions of the pet's underbelly. A third strap is adapted to overlie the pet's back when the pet is cradled by the straps to prevent the pet from falling off the structure.

The speed of rotation of the wheels may be adjusted so that the device is not subject to undesirably rapid displacement across a support surface, to avoid injury to the pet. Further, a leash may be releasably attached to the device so that even a totally disabled pet can be exposed to the therapeutic effects of travelling out of doors while recuperating.

An additional safety feature includes the provision of shock absorbing means to attenuate the effects of uneven surfaces over which the pet may travel.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF THE PREFERRED EMBODIMENT

Figure 1:
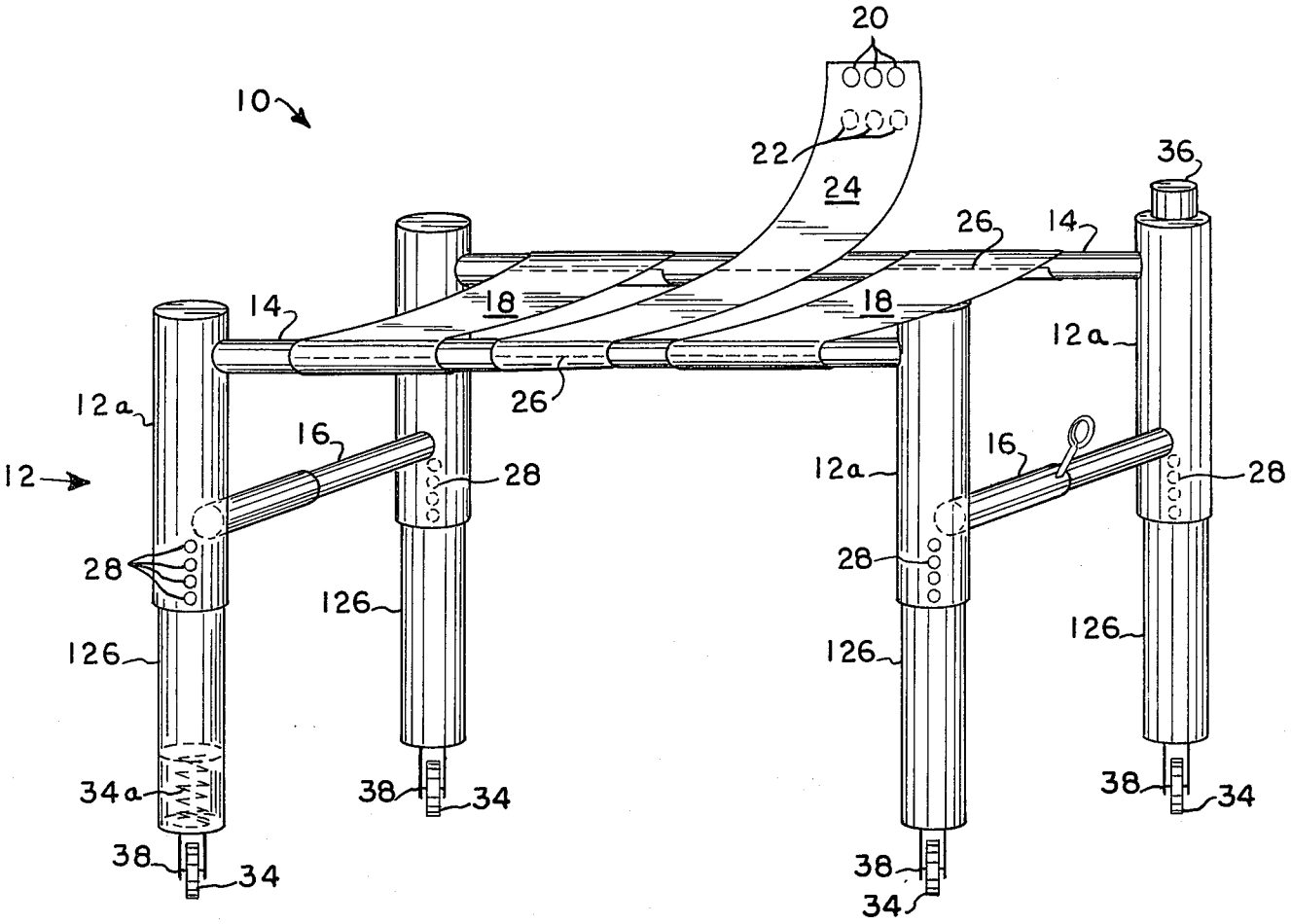
FIG. 1 is a perspective view of the preferred embodiment of the invention.

Referring now to FIG. 1, it will there be seen that a structure that incorporates the features of the invention is designated 10 as a whole.

The structure 10 presents a rectangular profile when seen in plan view, to thereby generally correspond to the body of a cat, dog, or other domesticated quadruped (not shown).

Four bifurcated upstanding leg members, collectively designated 12, each of which has a first, increased diameter portion 12*a* and a second, decreased diameter portion 12*b*, telescopically received therein, collectively define the corners of the rectangular structure, and are interconnected by longitudinally disposed brace members 14, 14 and transversely disposed brace members 16, 16. Each brace member 14, 14, 16, 16 is fixedly secured by suitable means, such as welding, at its opposed outermost ends to its associated leg members 12, 12.

The longitudinally disposed braces 14, 14 lie in a common horizontally disposed plane which is vertically offset from the common horizontally disposed plane of the transverse braces 16, 16, for reasons that will become apparent as this description proceeds.

Figure 2:
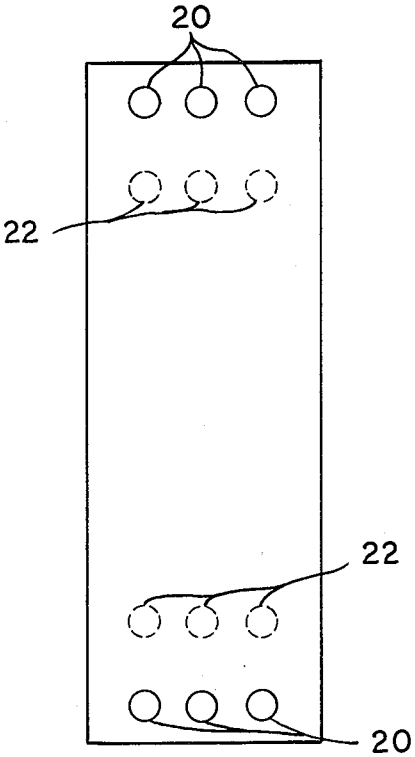
FIG. 2 is a plan view of the straps 18 or 24 of FIG. 1.

A pair of transversely disposed strap members 18, 18 interconnect the longitudinal braces 14, 14 as shown, and are provided to comfortably support the trunk or underbelly portion of the pet. The straps 18 are formed of a flexible, substantially non-extensible material, such as leather of vinyl, to conform to the contour of the pet's body. The opposed ends of each strap 18 carry a plurality of buckle means 20, as shown in FIG. 2, for snap fit engagement with an associated buckle-receiving snap means 22, which snap means 22 are spaced inwardly of said buckle means 20 by a distance substantially equal to the diameter of the individual brace members 14, 14 so that the straps are secured to the braces 14, 14 by first wrapping said opposed ends around the respective braces 14 and then by releasably engaging said snap and buckle members 20, 22.

An additional strap member 24 may be interconnected at its opposing ends to said braces 14, 14 in the same manner. Such strap member 24 may be disposed intermediate the support straps 18, 18 as shown in FIG. 1 and should have a length substantially greater than the length of said support straps 18, 18 so that it can be wrapped in overlying relation around the trunk portion of the pet after the pet has been placed into supporting relation to said supporting straps 18, 18. The elongate strap 24 is thus understood to be a restraining strap to prevent the pet from falling by executing a roll over the longitudinal braces 14, 14.

An alternative embodiment contemplates releasably securing the supporting straps 18, 18 and the restraining strap 24 to the opposed braces 14, 14 by insertion of the opposed ends of the straps through a complementally formed, strap-receiving slot means 26 individual to such straps. To simplify the drawings, such slots 26 are shown in phantom lines in FIG. 1, it being understood that the illustrated embodiment does not utilize said slots. Whether snaps and buckles 22, 20 or slots 26 are employed, it is preferred that the length of each strap 18, 18 or 24 be adjustable.

Figure 3:
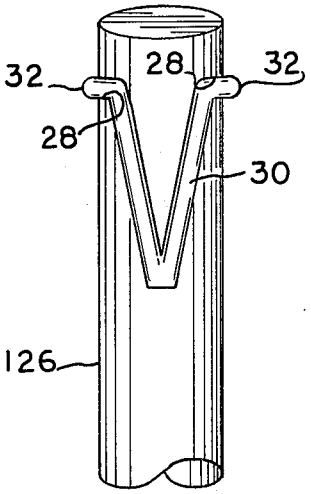
FIG. 3 is a longitudinal partial cross section of a tubular member 12*b*, 14*b* or 16*b*, showing the locking means disposed therein.

As aforesaid, the upstanding legs 12, the longitudinal braces 14, 14 and the transverse braces 16, 16 are of bifurcated construction so that the height or length thereof may be adjusted by telescoping the respective associated independently formed sections in relation to one another. It will also be observed, in FIG. 1, that each enlarged diameter leg or brace member is provided with a plurality of linearly aligned perforations or apertures 28. The mating, independently formed reduced diameter member of each leg or brace member (12*b*, 14*b*, 16*b*) is provided with a single aperture of matching diameter. A "V" shaped, resilient locking member 30, shown in FIG. 3, is disposed interiorly of the reduced diameter member (12*b*, 14*b*, 16*b*)—having the single aperture—and is pre-stressed so that its opposing free ends 32, 32 tend to diverge. When it is desired to increase or decrease the height of the structure 10 to accommodate pets of differing sizes or to place more or less weight on the pet's legs, or when it is desired to increase the width or length of the structure 10 by extending or retracting the braces 14, 14 or 16, 16, the free ends 32, 32 of the locking members 30 are depressed, the desired length adjustment is made, and the free ends 32, 32 are released. The resilience of the locking member 30 causes each free end 32, 32 to extend through its associated single aperture and to extend through the associated apertures 28 formed in the outer independently formed increased diameter section that aligns with the individual aperture when the desired position has been attained. In this manner, the length, width and height of the inventive structure are easily adjustable.

A wheel means 34 is rotatably mounted on the lowermost end of each upstanding leg 12, as clearly shown. To increase the friction—for safety purposes—between the wheels 34 and a support surface, not shown, one of two methods or a combination of both, may be employed. Weights 36 of sufficient mass to retard the rotation of the wheels 34 may be mounted as shown in FIG. 1, or anti-rotation friction devices, such as brake means 38 may be employed. Such means may be adjusted, as the pet's strength returns.

An eyebolt 40 is preferably provided on transverse brace 16 to provide a mounting means for a leash 42. For pets able to achieve locomotion with the aid of the structure 10, the leash serves its usual function. However, for pets unable to ambulate even when supported by the structure 10, the leash 42 enables the pet's owner to transport the pet when the pet is resting comfortably on the straps 18, 18. Such passive locomotion provides therapeutic effects. A shock absorber means is preferably provided at each wheel 34 and is diagramatically represented by a compression spring means, shown in phantom lines and collectively designated 34*a* in FIG. 1.

The adjustability of the structure 10 in all three dimensions, coupled with its rectangular structure, enables it to accommodate pets of differing heights, widths and lengths and further enables it to support the pet so that the pet can accomplish locomotion regardless of which limb or limbs may be incapacitated.

It should of course be understood that although stepwise, or discrete, adjustment means have been shown and described, it is also within the scope of this invention to provide continuous adjustment means so that an infinite number of functional positions of vertical, longitudinal and transverse adjustments could be provided.

It will thus be seen that the objects set forth above, and those made apparent by the preceding description, are efficiently attained, and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language might be said to fall therebetween.

Now that the invention has been described,

That which is claimed is:

1. An apparatus for partially or completely supporting a domesticated quadruped suffering from infirmities which impede or disable it from normal locomotion, comprising, a frame assembly, said frame assembly having a plurality of upstanding leg members disposed in longitudinally and transversely spaced relation to one another to define a generally rectangular configuration when seen in plan view, each of said leg members supported by a caster means mounted at the respective lowermost ends thereof for rotatable engagement with a support surface, a plurality of longitudinally disposed brace members for rigidly interconnecting longitudinally spaced ones of said leg members, a plurality of transversely spaced brace members for rigidly interconnecting transversely spaced ones of said brace members, means supported by said frame for supporting said quadruped so that all or part of the weight of said quadruped can be transferred from the legs of the quadruped to the legs of said frame assembly, means for adjusting the length of said leg members, said longitudinally disposed brace members and said transversely disposed brace members so that said frame assembly can be adjusted to accommodate pets of differing heights, lengths, and widths, said leg members, and said longitudinally and transversely disposed brace members being of tubular construction, each of said members comprising first and second bifurcated, axially aligned, telescoping portions, and dichotomous locking means being provided so that the length of each member can be changed when said locking means is disengaged and fixed when said locking means is engaged.

2. The apparatus of claim 1, further comprising means for hindering the displacement of said apparatus relative to a support surface.

3. The apparatus of claim 2, wherein said hindering means comprises weight members disposed in weighting relation to at least one of said upstanding legs.

4. The apparatus of claim 3, wherein said hindering means comprises brake means disposed in adjustable friction-imparting relation to at least one of said caster means.

5. The apparatus of claim 4, further comprising a mounting means attached to said frame apparatus to which a leash means can be releasably secured.

6. The apparatus of claim 5, further comprising means for absorbing the shock imparted to said wheel means attendant travel thereof over an unever support surface.

* * * * *